United States Patent [19]

Klose

[11] Patent Number: 4,950,355

[45] Date of Patent: Aug. 21, 1990

[54] METHOD OF AND APPARATUS FOR MANUFACTURING A MINERAL FIBER INSULATING WEB

[75] Inventor: Gerd R. Klose, Bundesrep, Fed. Rep. of Germany

[73] Assignee: Deutsche Rockwool Mineralwoll - GmbH, Fed. Rep. of Germany

[21] Appl. No.: 249,137

[22] Filed: Sep. 26, 1988

Related U.S. Application Data

[62] Division of Ser. No. 146,005, Jan. 20, 1988.

[30] Foreign Application Priority Data

Jan. 21, 1987 [DE] Fed. Rep. of Germany ..... 3701592

[51] Int. Cl.[5] ..... B32B 31/18

[52] U.S. Cl. ..... 156/204; 156/205; 156/207; 156/227; 156/254; 156/264; 156/443; 156/459; 156/512

[58] Field of Search ..... 156/204, 227, 250, 254, 156/260, 264, 443, 459, 474, 512, 62.6, 62.8

[56] References Cited

U.S. PATENT DOCUMENTS

| | | | |
|---|---|---|---|
| 2,500,690 | 3/1950 | Lannan | 156/204 |
| 2,684,107 | 7/1954 | Schultz | 156/204 |
| 3,012,923 | 12/1961 | Slayter | 156/204 |
| 4,128,678 | 12/1978 | Metcalfe et al. | 156/254 |

*Primary Examiner*—Caleb Weston
*Attorney, Agent, or Firm*—Diller, Ramik & Wight

[57] ABSTRACT

A method of and apparatus for manufacturing a mineral fiber insulating web by providing an uncured primary nonwoven mineral fiber web treated with binding agent, conveying the primary nonwoven mineral fiber web along a predetermined path of travel, compacting the primary nonwoven mineral fiber web, severing the primary nonwoven mineral fiber web into at least two secondary nonwoven mineral fiber webs, compressing at least one of the secondary nonwoven mineral fiber webs substantially beyond the initial compaction of the primary nonwoven mineral fiber web, positioning the compressed and remaining of the two secondary nonwoven mineral fiber webs into contiguous relationship to each other, and curing the binding agent to adhere the secondary nonwoven mineral fiber webs to each other thereby forming a cured multi-ply mineral fiber web or strip.

The method is varied by fan-folding the mineral fiber web after the same has been compressed and thereafter at least partially curing the fan-folded mineral fiber web and proceeding as aforesaid.

The apparatus includes opposing pairs of compression rollers or compression belts for compressing the secondary nonwoven mineral fiber web, guides for moving the secondary nonwoven mineral fiber webs out of the plane of the uncured primary nonwoven mineral fiber web, saw for cutting the uncured primary nonwoven mineral fiber web selectively along horizontal or vertical planes, guides for aligning the compressed secondary nonwoven mineral fiber web into contiguous relationship with a remaining secondary nonwoven mineral fiber web, and reinforcement/treatment systems for improving surface characteristics, heat transference, moisture permeability and the like.

14 Claims, 5 Drawing Sheets

FIG.7
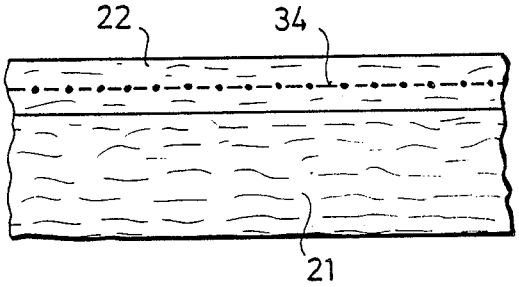
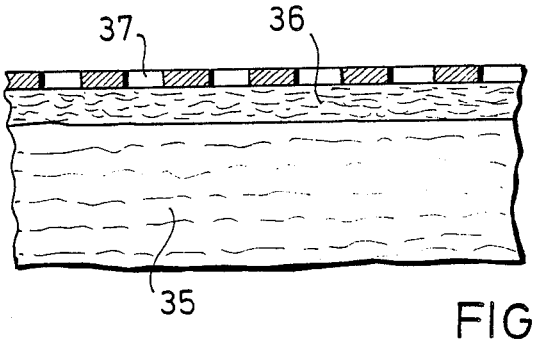
FIG.8
FIG.9
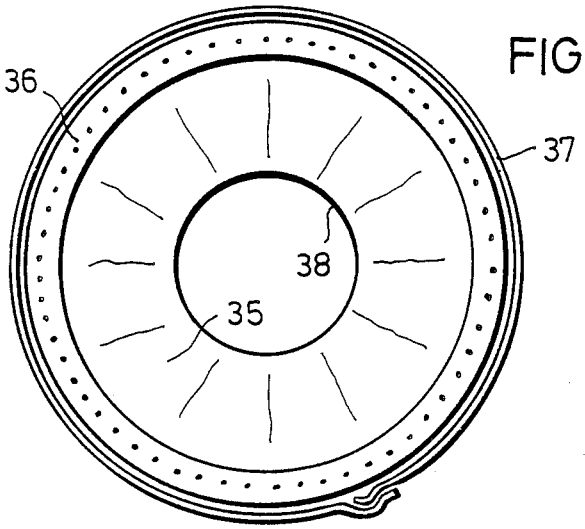

METHOD OF AND APPARATUS FOR MANUFACTURING A MINERAL FIBER INSULATING WEB

This application is a division, of application Ser. No. 07/146,005, filed Jan. 20, 1988.

FIELD OF THE INVENTION

The invention is related to a novel method for the continuous manufacture of fibrous insulating web, strip or like material which is normally formed from mineral fibers, such as rockwool fibers and glass fibers. The mineral fibers are impregnated with adhesive binders and impregnating agents (lubricants) in a conventional reservoir and exit therefrom as a primary nonwoven mineral fiber web. Minereral fiber webs of this type are then guided to a curing oven to cure the binders and the impregnating agents forming strips, webs, sheets, bats of mineral fiber insulating material.

DESCRIPTION OF THE RELATED ART

Heretofore mineral fiber insulating webs, panels, bats or strips (hereinafter webs) are manufactured as aforesaid and when viewed in cross-section, the mineral fibers thereof are substantially homogenous. That is, throughout the cross-section of any particular mineral fiber insulating web, there is generally the same bulk density and strength which may, however, vary somewhat depending upon the degree of compaction applied to the primary nonwoven mineral fiber web as it leaves the reservoir, the alignment of the mineral fibers thereof, the proportion of the binders, etc. This homogeneity is particularly evident in mineral fiber insulating webs made of vitreously solidified mineral fibers whose cross-sectional characteristics are virtually unchanged throughout the web. However, depending upon the particular end use of the mineral fiber insulating web, it may not be desirable to have totally homogeneous mineral fiber insulating webs. For example, it is conventional to improve the surface strength and/or the flexibility of surface layers of such insulating mineral fiber webs by laminating thereto other materials which can include another web of mineral fiber insulating material which is of a relatively high density. Alternately, it is known to laminate glass nonwoven fabrics, textile fabrics, metal nettings, foils and the like to such homogeneous mineral fiber insulating webs to mechanically alter the characteristics of the final product. These known procedures all take place after the homogeneous mineral fiber insulating web is first passed through a curing oven and the binders and impregnating agents are totally cured and the insulating web is totally formed. In other words, such laminations where similar depositions take place in accordance with known prior art only after the mineral fiber insulating web has been totally cured. Obviously, the additional step of laminating after manufacturing the mineral fiber insulating web is not cost-effective, particularly if the laminating requires the utilization of another curing oven. Furthermore, lamination necessarily requires additive labor which is additionally cost-prohibitive

SUMMARY OF THE INVENTION

In view of the foregoing, a primary object of the present invention is to provide a novel continuous method of manufacturing a laminated cured multi-ply mineral fiber web, particularly a web which is basically constructed from insulating mineral fibers. However, contrary to the homogeneous nature of conventional mineral fiber webs, the multi-ply mineral fiber web of the present invention is heterogeneous in cross-section to accommodate desired qualities, such as high resistance to heat, exterior surface toughness, air permeability and the like.

In accordance with the present invention, an uncured primary nonwoven mineral fiber web formed in the conventional manner is split into two or more secondary nonwoven mineral fiber webs before these secondary webs are introduced into the conventional curing oven. At least one of the two secondary nonwoven mineral fiber webs is moved along a predetermined path of travel which deviates from the path of travel of the primary nonwoven mineral fiber web and the other of the secondary nonwoven mineral fiber webs. As the one secondary nonwoven mineral fiber web is so moved along its path of travel, it is compressed well beyond the normal compaction of the mineral fibers of the primary nonwoven mineral fiber web in the conventional manufacture thereof, and after having been compressed this one secondary nonwoven mineral fiber web is then brought into contiguous relationship to the other of the secondary nonwoven mineral fiber webs and laminated thereto in the conventional curing oven. Therefore, in this fashion the compression of the mineral fibers of the one secondary nonwoven mineral fiber web alters the characteristics thereof and when laminated to the other of the secondary nonwoven mineral fiber webs, the resultant laminated multi-ply mineral fiber web lacks homogenity through its cross-section. Accordingly, without adding man power or material equipment, as will be noted more fully hereinafter, the present invention affords the manufacture of an extremely controlled hetrogeneous laminated mineral fiber web whose properties can be altered immeasurably by, for example, simply altering the degree of compression to which the one secondary nonwoven mineral fiber web is subjected. The intense compression applied to the one secondary nonwoven mineral fiber web is such that the mineral fibers tend to align in the direction of travel, whereas in a conventional primary nonwoven mineral fiber web, the mineral fibers are substantially arrayed in a random fashion. Therefore, by doing little more than compressing the one secondary nonwoven mineral fiber web and reuniting it to the compacted, though uncompressed, remaining secondary nonwoven mineral fiber web, the characteristics of the eventually laminated multi-ply mineral fiber web differ substantially from identical mineral fiber webs in which none have been compressed.

In accordance with this invention, it has been found to be particularly advantageous to compress the one secondary nonwoven mineral fiber web down to approximately one-third to one-fifth of its original thickness which increases the density three to five time original. The thickness of the various secondary non-woven mineral fiber webs can vary, but it has been found that the thickness of the secondary nonwoven mineral fiber web which is to be compacted is selected so that in its highly compressed state, it is approximately 5 mm thick. This thickness may vary depending upon end use. In order to assure high compression, preferably the secondary nonwoven mineral fiber web is edgeguided so that when compressed the mineral fiber material can not expand laterally and will be compressed to the desired degree. Once compressed, the compressed mineral fiber web is retained between guides so that it will not loose its compression prior to being cured. As an alternative to the latter, a viscous binder can be applied to the compressed secondary mineral fiber web prior to or after it has been compressed, the binder at least partially cured, and this assures that the compressed mineral fiber web will not alter in its compression before final curing.

In accordance with this invention, it has been found advantageous to convey the primary nonwoven mineral fiber web horizontally and split it into secondary mineral fiber webs by cuts taken in one or more generally horizontal planes. However, in cases where the primary nonwoven mineral fiber web is relatively thick, that is where the weight ratio of the different structures should be 1:1, so that the secondary mineral fiber web which is to be compressed is initially as thick as the remaining primary nonwoven mineral fiber web, it is more advantageous to sever the primary nonwoven mineral fiber web by one or more vertical cuts forming one or more secondary nonwoven mineral fiber webs. These secondary nonwoven mineral fiber webs are then guided to a position, one above and contiguous the other, just as they arrive at the curring oven, preceded by, of course, the application of compressive forces to one, more or all thereof.

In further accordance with this invention, the compressed secondary nonwoven mineral fiber web is cured at least across partial regions thereof, particularly when a binder has been added thereto, by heat through microwave generators or hot-air generators or surface radiators. This partial curing takes place prior to the conventional curing oven to make certain that the compressed secondary mineral fiber webs do not expand.

In further accordance with this invention, additional binders are deposited between the secondary nonwoven mineral fiber webs, including the compressed secondary nonwoven mineral fiber webs. Preferably, such binders are deposited upon mutually opposing surfaces of the secondary and primary mineral fiber webs so that when the latter are brought to contiguous superimposed relationship and eventually cured, they are reliably bonded to each other and the final laminated cured multi-ply mineral fiber web is not subject to delamination.

In further accordance with this invention, two secondary nonwoven mineral fiber webs can be compressed and an uncompressed merely compacted secondary nonwoven mineral fiber web sandwiched therebetween prior to being fed into the curing oven. In this fashion, the finished laminated cured multi-ply mineral fiber web has stronger harder outer laminates or surfaces which, in the case of mineral fiber insulation, provides a stronger mechanical securement to associated building structures, particularly when used as wall insulations or bonded to roofs as mineral fiber insulating panels. Such multi-ply laminated mineral fiber webs are highly user-friendly and are highly wind-resistant which is extremely important when these mineral fiber webs or panels are used as the final outer walls of buildings or the like.

The present invention also contemplates treating the exterior of the compressed secondary mineral fiber web with impregnating agents which render the exterior surface grindable, thereby providing a stone-like appearance. Obviously, the exterior surface of the compressed secondary mineral fiber web can be painted to enhance its appearance. Additionally, the exterior surface of the compressed secondary nonwoven mineral fiber web can be treated or coated with materials which are heat-resistant to 1,000° C., in particular those precipitating in the known sol-gel process. Furthermore, while the exterior of the compressed secondary mineral fiber web can be treated, it is also within the scope of this invention to provide a variety of barriers between the secondary nonwoven mineral fiber webs as, for example, a humidity barrier in the form of metallic foil, plastic sheet material, or the like. Moisture tending to penetrate, particularly from the exterior toward the interior, is prevented from doing so by such barriers. In lieu of or as in addition to the barrier sheet material, air-permeable strip material or thermally stable reinforcing material, in the form of thin nonwoven fabrics, gauzes or netting can be applied in a continuous fashion on the outside, inside, and/or between the various secondary nonwoven mineral fiber webs, compressed or noncompressed, depending upon the particular end-product characteristics desired. The latter all will, of course, increase the tear-resistance of the particular mineral fiber web so treated.

In accordance with the present invention, in lieu of webs, foils, netting or the like, the surfaces (outside and/or inside) of the compressed secondary nonwoven mineral fiber webs may be sprayed with metallic or ceramic fibers or particles which include inorganic binders, particularly water glass and its derivatives or with silicic-acid esters of colloidal silicic acid. The latter additives make the surfaces to which they are applied substantially stronger and resistant to abuse.

In further accordance with this invention, reflecting materials such as metal powders, metal fabrics, metal nettings, or ceramics, such as mica are introduced into the secondary nonwoven mineral fiber web before the same is compressed so that these materials will be thoroughly imbedded therein. When a mineral fiber web is so manufactured to be used as an insulator, the heat conductivity is substantially reduced, particularly at high temperatures, and especially by the surface so treated which will reflect intense heat rays.

When in accordance with this invention, the primary nonwoven mineral fiber web is split or severed one or several times along a horizontal plane, a plurality of secondary nonwoven mineral fiber webs are created and each can be created to have different characteristics depending upon materials which may be added to, upon or into one or more of these secondary nonwoven mineral fiber webs. For example, reflecting materials can be introduced into one of the secondary mineral fiber webs at distances less than 20 mm from the exterior most surface of the mineral fiber web which is to be the exterior-most laminate of the finished laminated cured multi-ply mineral fiber insulating web or strip. Others of the secondary nonwoven mineral fiber webs more interior thereto might be otherwise treated as, for example, being treated or coated with heat-resistant materials to increase flame or fire-resistant characteristics of the end product.

The various applications to the basic invention provide several advantages. By first deciding exactly the end use of the finished laminated cured multi-ply mineral fiber web, one can suitably construct the same to have all desired characteristics. For example, if one were to manufacture panels for the exterior of a building, the exteriormost web or laminate would desirably be strong, tough and abrasion-resistant, whereas the interior laminate or web might have heat-resistant characteristics. By selecting a primary nonwoven mineral fiber web of a particular thickness, splitting the same into two secondary nonwoven mineral fiber webs, compressing one of the latter, treating the other of the latter, a desired building insulation panel can be produced at, of course, low cost and in a continuous fashion. Furthermore, by employing a variety of reinforcing wire mesh webs or nettings, wire-net mats can be manufactured in which the wire net is entirely integrated in (or between) the surface of one or the other of the two secondary nonwoven mineral fiber webs. In this fashion, when a staple is used to secure an mineral fiber insulation panel having wire net therethrough to the building wall, the staple will not simply tear through the insulation material, as is typical in conventional insulating material, but will instead grip the metallic net and adhere to the building structure. Obviously, in the case where the wire net is entirely integrated in the exteriormost compressed secondary nonwoven mineral fiber web, the mineral fibers of the latter prevent undesired direct contact between the wire net and, for example, metallic building sheet metal cladding, such as aluminum. By reducing metal-to-metal contact, the insulation properties are vastly increased. Panels made of such wire net are also very flexible and can be used as insulators to insulate flexible roof panels while simultaneously assuring bridging of contours, such as trapezoidal channels in roof constructions. The flexiblity also permits such panels to be used to insulate pipe cladding.

In further accordance with this invention, foaming agents can be integrated into the secondary nonwoven mineral fiber web which is to be compressed in order to increase the fire-resistance duration thereof, and this is particularly recommended for constructions components (building paneling) that might be exposed to high temperatures in the event of a fire.

Another aspect of the invention is that the compression of the uncured primary nonwoven mineral fiber web to form therefrom an uncured, though compressed, primary nonwoven mineral fiber web which can be partially cured to prevent expansion and then fan-folded to form a partially cured folded mineral fiber web. The fan folds of this mineral fiber web are adhered together by the embedded binder which is partially cured. This web is then fed toward a severing station at which one or more partially cured secondary nonwoven mineral fiber layers are removed therefrom along a generally horizontal severence line. The fan folds are thus cut generally transverse to their length and when secondary mineral fiber webs so severed are eventually subjected to the compression heretofore noted, laminates formed therefrom have extremely high compression strength in the direction normal to the plane of the finished cured multi-ply mineral fiber web, strip or paneling (insulation or otherwise). Also, as partially cured severed mineral fiber fan-folded secondary webs are conveyed toward the curing oven, these can be conveyed at different speeds resulting in the mineral fibers being compressed to different degrees, and when laminated the various mineral fiber webs of the laminate will have different compression characteristics, though all will exhibit relatively high compression strength normal to the major plane of the web or panel. Preferably, binders and reinforcing materials are deposited upon the primary compressed nonwoven mineral fiber web prior to and/or after it has been fan-folded to assure that the at least partially cured fan-folded mineral fiber web formed therefrom will have stability during the remainder of the process. Obviously, the latter additives also assure product strength, durability and absence of delamination, and, if desired, reinforcements as latter-noted can be utilized in conjunction with this method.

It is also in keeping with this invention to reinforce the uncured primary compressed nonwoven mineral fiber web prior to fan-folding thereof by applying loose mineral fibers and a binder by a spray to additionally assure adherence and prevent unfolding once the folded mineral fiber web is at least partially cured. The spray system might also utilize thermally resistant fibers which prior to this invention were operative to 750° C., whereas in accordance with this invention fire-resistant-/insulation panels are heat-resistive to approximately 1,000° C.

It is also in keeping with this invention to apply a thin web of reinforcing material to the uncured primary nonwoven mineral fiber web as it is being compressed to add stability during the continuation of the process and strength to both the partially cured fan-folded mineral fiber web and the eventually finally cured mineral fiber fan-folded web.

While the fan folds are formed in accordance with the preferred embodiment of this aspect of the invention generally normal to the major plane of the mineral fiber web or eventually formed panel, the fan-folds can be formed in a series of consecutive horizontal steps whereby the desired strength properties can be matched to a desired in-use application.

In accordance with this invention, the methods just described are also implemented by novel apparatus including severing or separating devices in the form of circular or band saws which can sever the uncured primary nonwoven mineral fiber webs along horizontal or vertical planes. Furthermore, the compression of the one or more secondary nonwoven mineral fiber webs is accomplished by one or more pairs of compression rollers, and preferably between the pairs of rollers there is located a binder applicating roller and a back-up roller followed by a variety of treatment systems including heat-generating systems to at least partially cure the compressed secondary mineral fiber web prior to being laminated in the curing oven.

In lieu of the latter, guides may be provided between the last set of compression rollers between which the compressed secondary nonwoven mineral fiber web will travel until it is applied to another secondary nonwoven mineral fiber web before being laminated thereto in the curing oven. Such guides prevent the mineral fibers from re-expanding and maintain the mineral fiber web at its desired compressed state.

In the aspect of the method involving the fan-folding of the uncured primary compressed nonwoven mineral fiber web, the latter is preferably fed between a pair of conveyor belts which are swung is an oscillating fashion to create the fan-folds and therefrom the relatively thick fan-folded mineral fiber web.

With the above and other objects in view that will hereinafter appear, the nature of the invention will be more clearly understood by reference to the following detailed description, the appended claims and the several views illustrated in the accompany drawings.

BRIEF DESCRIPTION OF THE DRAWINGS

FIG. 6 is a fragmentary longitudinal cross-sectional view of another laminated multi-ply mineral fiber web, and illustrates relatively thin exterior compressed layers or plies and an interior relatively thick uncompressed layer or plies reinforced by netting, mesh, web material or the like.

FIG. 7 and FIG. 8 are fragmentary cross-sectional views, and each illustrates other embodiments of the laminated multi-ply mineral fiber webs.

FIG. 9 is a front elevational view of pipe insulation constructed in accordance with this invention and illustrates the flexibility thereof in surrounding relationship to an associated pipe.

DESCRIPTION OF THE PREFERRED EMBODIMENT

Figure 1:
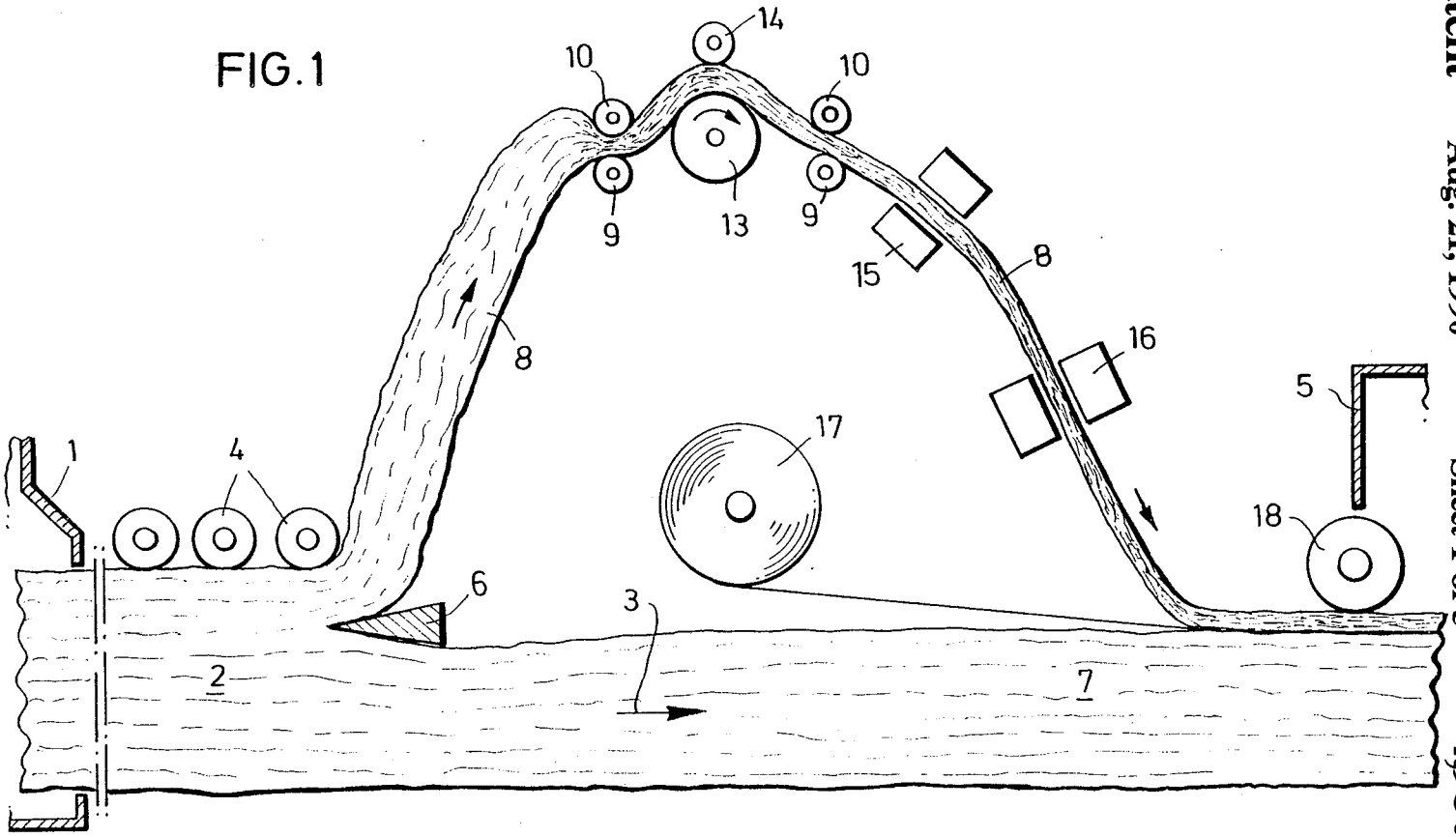
FIG. 1 is a diagrammatically side elevational view of a novel apparatus for manufacturing laminated cured multi-ply mineral fiber (insulation) web in accordance with this invention, and illustrates a conventional reservoir, compacting rolls downstream therefrom, a severing device, two pair of compression rollers, a treatment system, and a curing oven for transforming two severed secondary nonwoven mineral fiber webs into a finished laminated cured multi-ply mineral fiber web from which insulating or like panels can be fabricated.

The novel apparatus for forming laminated cured multi-ply mineral fiber (insulating) web, strip or like material is diagrammeticaly illustrated in FIG. 1, and illustrates conventional reservoir means in the form of a reservoir 1. Fibers, particularly mineral fibers, which are used to form insulating webs, strips, bats, panels or the like, are deposited in the reservoir 1 in a conventional manner with binders and impreganting agents. The materials exit the reservoir 1 in the form of an uncured primary nonwoven mineral fiber web 2 which is conveyed by conveying means, diagrammatically indicated by the numeral 3, in the direction thereof. The uncured primary nonwoven mineral fiber web is fed between a series of compacting rollers 4 of which only the upper set are shown, but it is to be understood that a lower set of such compacting rollers are also provided in opposition to those illustrated. In lieu of the compacting rollers, compacting endless belts might be used, but in either case the uncured primary nonwoven mineral fiber web is moved therebetween and subject to relatively light compaction as it is advanced by the conveying means or conveyor 3 toward a conventional curing oven 5 which cures the binders and the impregnating agents in a conventional manner.

In accordance with this invention, the totality of the uncured primary nonwoven mineral fiber web 2 is not directly fed to the curing oven 5, as is conventional, but is instead subjected to the operation of severing means 6 which is diagrammatically illustrated as a severing or separating device, such as, for example, a blade saw or a band saw. The severing means 6 is located between the reservoir 1 and the curing oven 5 and severs the uncured primary nonwoven mineral fiber web along a generally horizontal plane separating the same into two secondary nonwoven mineral fiber webs 7 and 8 of which the former moves by the conveying means 3 toward the curing oven 5 and the latter is deflected along an upper path of travel by conventional guide means (not shown). The secondary nonwoven mineral fiber web 7 is not treated in any fashion whatsoever after exiting the reservoir 1 other than for eventually being laminated to the web 8, as will appear more fully hereinafter.

While the secondary nonwoven mineral fiber web 8 is shown in FIG. 1 as being moved along a predetermined path which is extremely vertical in nature, this is exaggerated for purposes of description, and in actual practice this angle is quite shallow and the two mineral fiber webs 7, 8 are relatively close to one another.

As the secondary nonwoven mineral fiber web 8 is advanced upwardly, it is fed through compression means in the form of one or more pairs of compression rollers 9, 10 and 9, 10, there being two such pairs illustrated in spaced relationship to each other. The compression rollers 9, 10 may instead be suitable endless compression belts. As the secondary nonwoven mineral fiber web is fed between the compression rollers 9, 10, it is appreciably compressed and its state or degree of compression is maintained until laminated to the secondary uncompressed nonwoven mineral fiber web 7. However, an important aspect of this invention is the fact that the compression rollers 9, 10 compress the mineral fibers or fibrous material of the secondary nonwoven mineral fiber web appreciably beyond its compacted nature, and in doing so many of the attributes heretofore noted are achieved in the eventually formed laminated multi-ply mineral fiber webs which eventually exit (not shown) the curing oven 5. Furthermore, the compressed secondary nonwoven mineral fiber web 8 is subjected to various treatments, also heretofore noted, which will be described hereinafter.

Preferably, adhesive or binder applying means 13, shown diagrammatically in the form of a gluing roller, is mounted between the two pairs of compression rollers 9, 10 and 9, 10. The binder applying means 13 is opposed by a conventional back-up roller 14, and the latter elements operate in a conventional manner to impress a viscous binder into the compressed secondary nonwoven mineral fiber web as it exits from between the first set of compression rollers 9, 10 and before entering the second set of compression rollers 9, 10.

Downstream of the last set of compression rollers 9, 10 is treatment means 15, preferably in the form of means for heating and at least partially curing the compressed secondary nonwoven mineral fiber web to assure that it will not expand under the inherent resilience of the mineral fibers thereof. The heating means 15 might be, for example, a microwave generator, a surface radiator, a hot air generator, and preferably heat is generated at opposite sides of the compressed web 8.

Though conveyor belts or similar guide means are provided on both sides of the mineral fiber web 8 from the severing means 6 to the curing oven 5, it is particularly important to provide such conveying means from between the last pair of compression rollers 9, 10 to the curing oven 5 or, alternatively, partially cure the compressed mineral fiber web 8 by heat generated through the heating means 15 to prevent the expansion heretofore noted. Obviously, once the compressed mineral fiber web 8 is partially cured, only limited guide means are necessary thereafter. The same heat applied by the heating means 15 can also impart mechanical and thermal properties to the compressed mineral fiber web 8, such as added strength, to reduce the guidance necessary after leaving the heating means 15.

Since the compressed mineral fiber web 8 is only partially cured as it leaves the heating means 15, it may be further treated downstream thereof by appropriate means 16, such as conventional spray means for applying reinforcement media in liquid form to opposite surfaces of the compressed mineral fiber web 8. Any of the foregoing materials heretofore described can be sprayed upon the partially cured compressed secondary nonwoven mineral fiber web 8 by the spray means 16 prior to reaching the curing oven 5.

Additional means 17 are diagrammatically illustrated for applying or depositing strips, sheets, webs, nets or the like between the mineral fiber webs 7, 8, depending upon the end product use of the final laminated multi-ply mineral fiber web produced in the curing oven 5. The means 17 is shown simply as a roller from which is drawn a web of air-permeable and/or thermally stable material, such as thin polyester nonwoven fabrics, gauzes, webs or nets. The material 17 might be a web of nonwoven glass, Fiberglas, gauze, metal gauze or metal mesh. The particular material fed by or drawn from the means 17 depends upon the end product use, as noted earlier herein.

A series of opposing compression rollers 18 (only one of which is shown) are located at the entrance of the curing oven 5 above the compressed mineral fiber web 8 and below (not shown) the uncompressed mineral fiber web 7. These compression rollers 18 or equivalent endless pressure belts are located at the entry and along the interior (not shown) of the curing oven 5. Thus, as the web (unnumbered) drawn from the means 17 and the other two mineral fiber webs 7, 8 are fed through the curing oven 5, the heat and continued pressure eventually laminates the structures to each other resulting in a reinforced cured laminated multi-ply mineral fiber (insulating) web which can be utilized for the various purposes heretofore defined. It is to be particularly noted that though the severing means 6 has been illustrated as severing but a single secondary nonwoven mineral fiber web 8 from the uncured primary nonwoven fibrous web 2, other severing means 6 (not shown) may be utilized to sever additional secondary nonwoven mineral fiber webs 8 from the uncured primary nonwoven mineral fiber web 2, subject the same (or not) to compression means corresponding to the means 9, 10, and subsequently reassemble all of these secondary nonwoven mineral fiber webs, and others webs drawn from the roll or means 17, to form the eventually laminated cured multi-ply mineral fiber web exiting (not shown) the curing oven 5. Accordingly, a variety of different laminates are possible in accordance with this invention, as will be more clearly described hereinafter.

Figure 2:
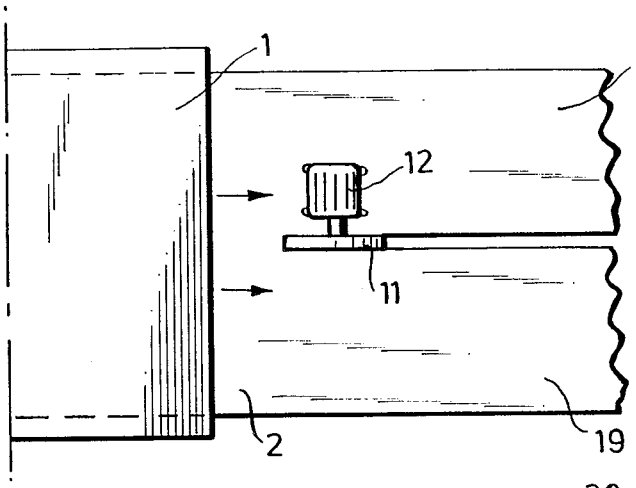
FIG. 2 is a fragmentary top plan view of a conventional reservoir, and illustrates a severing device which severs a primary nonwoven mineral fiber web along a vertical line of severence.
Figure 3:
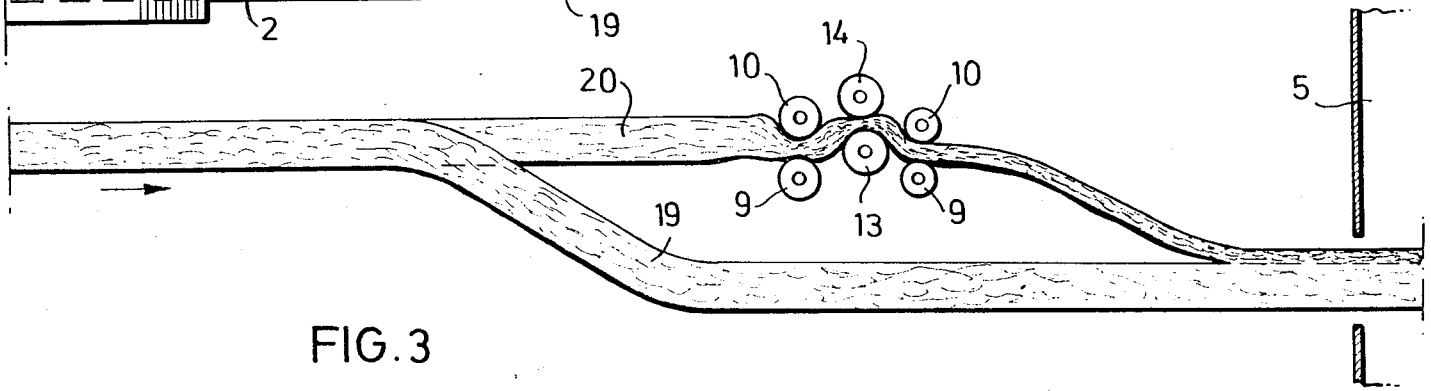
FIG. 3 is a highly diagrammatic side elevational view of the apparatus of FIG. 2, and illustrates two secondary nonwoven mineral fiber webs being initially separated, one being compressed, and the mineral fiber webs being reassembled and eventually laminated in a curing oven.

Reference is now made to FIGS. 2 and 3 of the drawings in which severence means or severing means 11 is shown as a blade 11 driven by a drive motor 12 for cutting the uncured primary nonwoven mineral fiber web 2 exiting the reservoir 1 along a generally vertical plane to separate the uncured primary nonwoven mineral fiber web into two secondary nonwoven mineral fiber webs 19, 20. The secondary nonwoven mineral fiber web 19 is fed directly to the curing oven 5, whereas the secondary nonwoven mineral fiber web 20 is subjected to extreme compression by means of the heretofore described compression means 9, 10 and the associated binder applicator means 13 and the back-up roll 14. Though unillustrated, means corresponding to the means 15 through 17 can be associated with the mineral fiber webs 19, 20. Means are also provided for selectively positioning the severing means 11 so that it might cut along a horizontal plane, and in this case the means 11 would be a band saw which could be alternatively utilized to cut either in the vertical plane of FIG. 2 or the horizontal plane of FIG. 1. However, irrespective of whether the cut is in a vertical or horizontal plane, once the mineral fiber webs 19, 20 have been brought back into contiguous relationship, introduced into the curing oven 5, and conveyed therethrough, the end result is the finished product, namely, a laminated cured multi-ply mineral fiber (insulated) web.

Figure 4:
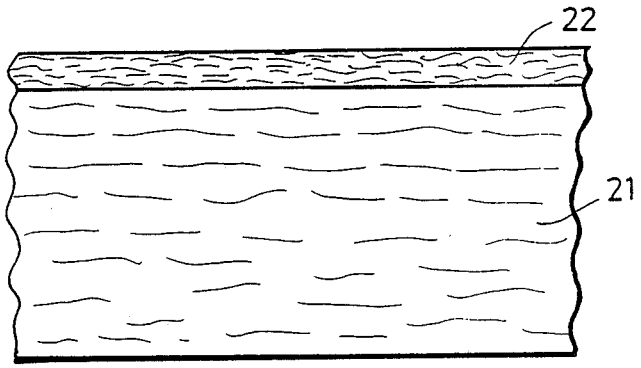
FIG. 4 is a fragmentary longitudinal cross-sectional view of a two-ply laminated cured mineral fiber web of this invention.

Reference is now made to FIG. 4 of the drawings which illustrates the cured laminated multi-ply mineral fiber web exiting the curing oven 5 of FIG. 1 or FIG. 2. The laminated multi-ply mineral fiber web includes a relatively thick compacted mineral fiber web, ply or layer 21 corresponding to the mineral fiber webs 7, 19 of FIGS. 1 and 3, respectively, and a highly compressed laminate, web or ply 22 corresponding to the compressed mineral fiber webs 8, 20 of FIGS. 1 and 2, respectively. The mineral fibers of the mineral fiber web 22 of FIG. 4 have a predominately laminar fiber structure, that is, the mineral fibers are aligned essentially horizontally or parallel to the direction of travel or the major area of the overall multi-ply laminated mineral fiber web. The latter occurs due to the aligning effect created by the compression means 9, 10, earlier noted. Accordingly, the laminated multi-ply mineral fiber web of FIG. 4 essentially consists of one relative dense mineral fiber layer 22 and one relatively less dense mineral fiber layer 21 with, of course, the unillustrated layer therebetween formed by the web drawn from the means 17 not being illustrated.

Figure 5:
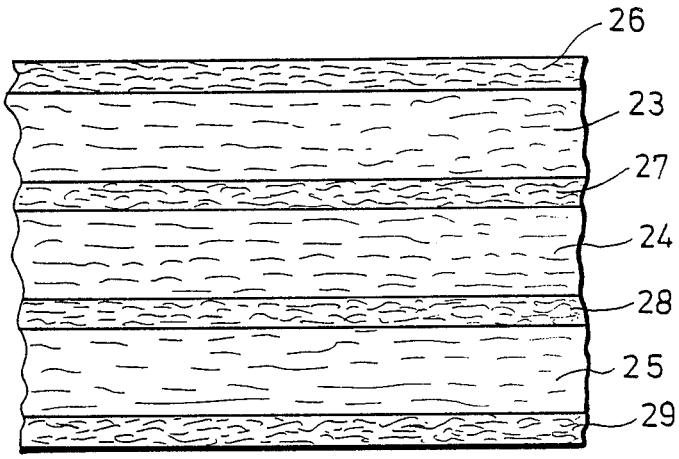
FIG. 5 is a fragmentary longitudinal cross-sectional view of another laminated cured multi-ply mineral fiber web, and illustrates alternating compressed and uncompressed (only compacted) mineral fiber webs, layers or plies.

Another multi-ply mineral fiber web is shown in FIG. 5 after exiting the curing oven 5, and the mineral fiber web includes mineral fiber layers 23, 24, and 25 which are simply compacted mineral fiber layers corresponding to the webs 7 and 19 of FIGS. 1 and 3, respectively. Mineral fiber webs, layers or laminates 26, 27, 28 and 29 are, of course, highly compressed and formed in the manner of the compressed mineral fiber webs 8, 20 of FIGS. 1 and 3, respectively. Thus, the laminated mineral fiber web of FIG. 5 has several compressed and compacted (generally uncompressed) mineral fiber layers with, of course, the more dense and stronger compressed mineral fiber layers being the outer layers 26, 29 of the laminated mineral fiber web.

Figure 6:
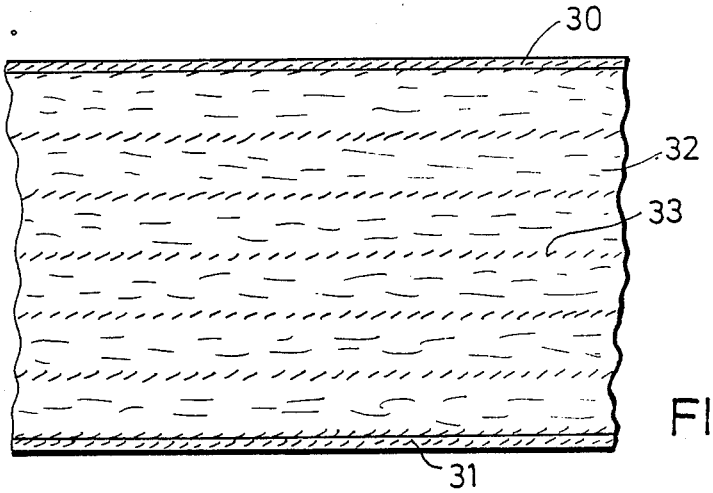

Reference is now made to FIG. 6 which illustrates another laminated multi-ply mineral fiber web forming an end product of the invention exiting the curing oven 5 which is formed having two highly compressed outer mineral fiber layers, webs or laminates 30, 31 and a compacted center mineral fiber layer, web or laminate 32 which has, however, been split into secondary mineral fiber webs, as heretofore described, with reinforcing or additive means 33 being applied between all such split secondary mineral fiber webs before the latter are brought back into contiguous relationship incident to being fed to the curing oven 5. The means 33 corresponds to any material which might be drawn from a web, as shown diagrammatically at 17 in FIG. 1, or metallic powder, metallic fabrics or other reinforcements applied between the secondary mineral fiber webs. Spray means 16 might also apply the means 33 to the secondary compressed mineral fiber webs, in the manner heretofore described relative to FIG. 1.

Referring to FIG. 7 of the drawings, another end product exiting the curing oven 5 in the form of a laminated multi-ply mineral fiber web is illustrated and includes a primary compacted nonwoven mineral fiber laminate strip or web 21 corresponding to the mineral fiber webs 7, 19 of FIGS. 1 and 3, respectively. Another mineral fiber web, laminate or strip 22 corresponds to the compressed mineral fiber webs 8, 20 of FIGS. 1 and 3, respectively. However, wire mesh 34 is shown embedded in the laminate 22, and this corresponds to a modification in FIG. 1 wherein an additional secondary mineral fiber web 8 is severed by the severing means 6, compressed, and sandwiched therebetween from the means 17, as the wire mesh 34, prior to all components of FIG. 7 being introduced into the curing oven 5. This product is particularly advantageous for stapling insulation paneling to building walls or ceilings.

In FIG. 8 of the drawings, the multi-ply mineral fiber web exiting the curing oven 5 includes a compact mineral fiber layer, web or laminate 35 corresponding to the mineral fiber webs 7, 19 of FIGS. 1 and 3, and a highly compressed mineral fiber web, ply or laminate 36, corresponding to the compressed mineral fiber webs 8, 20 of FIGS. 1 and 3, respectively. As an example, the compact mineral fiber layer has a density of 30 $kg/m^3$, whereas the highly compressed mineral fiber laminate 36 has a density of 120 $kg/m^3$. Furthermore, a sheet metal layer or foil 37 is laminated to the exterior of the compressed mineral fiber layer 36 which, of course, involves simply feeding the web from the means 17 of FIG. 1 atop or to the other side of the compressed mineral fiber web 8 between its uppermost surface and the illustrated compression roller 18. This laminated mineral fiber web is particularly well suited for insulating pipes 38, as is illustrated in FIG. 9.

Figure 10:
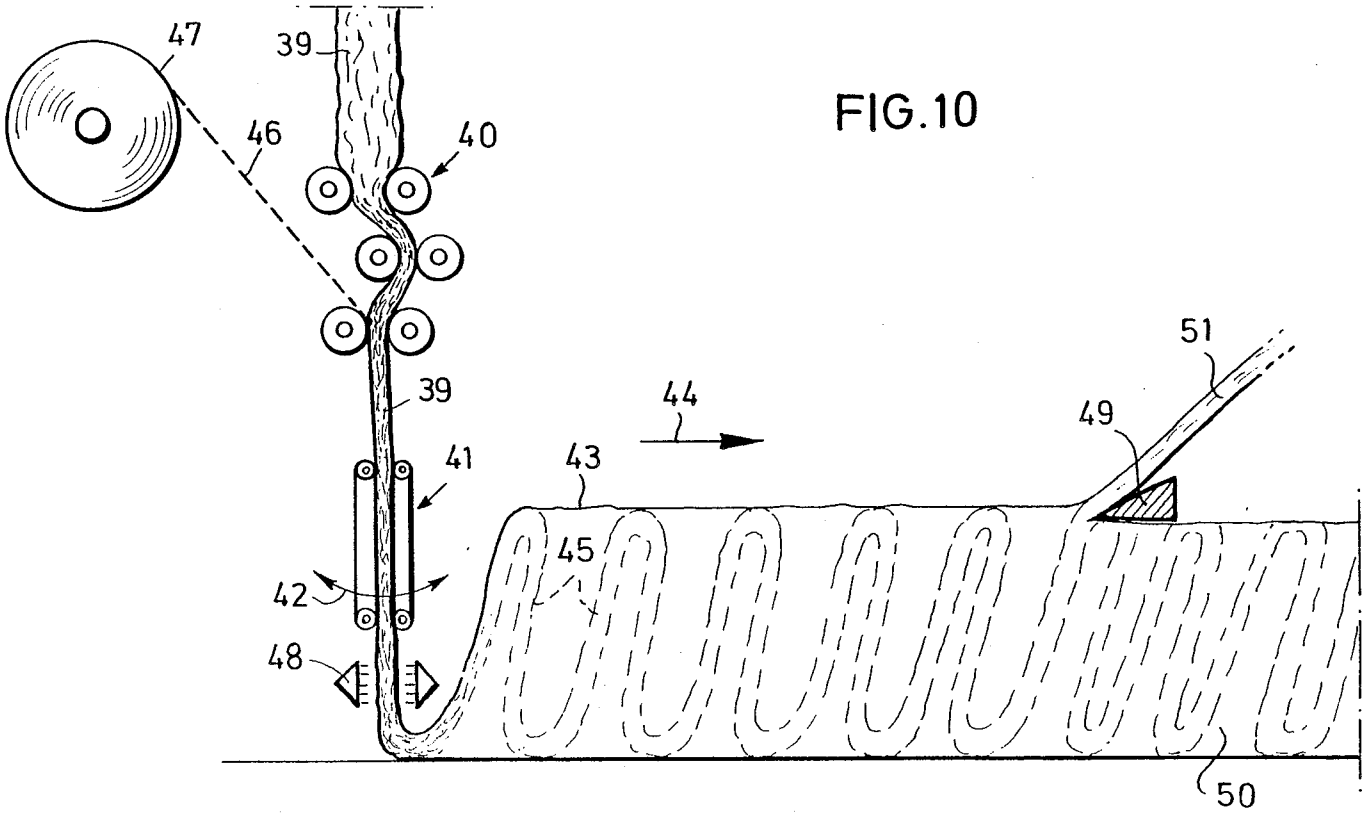
FIG. 10 is a fragmentary schematic side elevational view of another apparatus, and illustrates a primary nonwoven mineral fiber web fan-folded into a relatively thick mineral fiber web which is laminated further in accordance with FIG. 1.

Another apparatus of this invention for manufacturing any one of the laminated multi-ply mineral fiber webs heretofore described is shown in FIG. 10, but in lieu of the reservoir 1 and the compacting rollers 4, the apparatus of FIG. 1 operates by receiving uncured primary nonwoven mineral fiber web 39, a binding agent and the like from an unillustrated reservoir 1 in a generally vertical downward direction. The uncured primary nonwoven mineral fiber web 39 is fed through compression means 40 defined by two pairs of compression rollers (unnumbered) corresponding to the compression rollers 9, 10 of FIG. 1 and binder applicator means (unnumbered) corresponding to the means 13, 14 disposed therebetween. Means, generally designated by reference numeral 47, includes any or all of the possible web feeding means heretofore described for feeding web material 46 into the bight between the last compression roller and the primary web 39 passing therebetween. In this case the web material 46 is a relatively thin strip of air-permeable and temperature-resistant reinforcing strip or web material 46.

After the laminated uncured primary compressed nonwoven mineral fiber web 39 exits the last set of compression rollers (unnumbered) of the compression system 40, it is fed between means 41 in the form of a pair of driven endless conveyors which are continuously oscillated by means 42 diagrammatically depicted by a double-headed arrow which creates a series of fan-folds or accordion folds 45. Conventional means 48 are provided in the form of a spray system for depositing reinforcing media or binder at a suitable location as the fan-folds 45 are produced. A conveyor 44 is diagrammatically illustrated by the headed arrow associated therewith for moving the at least partially cured now fan-folded mineral fiber web 43 to the right, as viewed in FIG. 10. The fan-folds 45 are, of course, shown relatively spaced from each other, but it is to be understood that the rate of movement of the conveyor 44 and the motion of the oscillating means 42 forming the fan-folds 45 is such that the adjacent surfaces of adjacent fan-folds and the interiors thereof are in contact. The binder applied at 48 will, of course, prevent the fan-folds 45 from expanding, although any of the means heretofore described relative to FIG. 1 can be utilized.

As the partially cured fan-folded mineral fiber web 43 moves to the right by the conveyor 44, it encounters severing or severence means 49 corresponding identically to the severing means 6 of FIG. 1. At this point the severing means 49 severs the partially cured fan-folded mineral fiber web 43 into a relatively thin secondary nonwoven mineral fiber web 51 and another secondary nonwoven mineral fiber web 50. The two secondary mineral fiber webs 50, 51 and others can, of course, be similarly severed from the mineral fiber web 50. The secondary mineral fiber web 51 is then treated just as the mineral fiber web 8 of FIG. 1, namely, it is fed through compression rolls 9, 10, the binder applicator means 13, etc. and then reunited with the remaining secondary mineral fiber web 50 (or others formed therefrom) as these mineral fiber webs are introduced between the compacting rollers and fed in and through the curing oven 5.

The advantage of the eventually formed laminated multi-ply mineral fiber web exiting the curing oven 5 in accordance with the FIG. 10 apparatus is an extremely high compression strength normal to the major plane of the laminated web. The latter is because of the fan-folded nature of the folds 45 with are so formed that their lengths are normal to the web 43. Since the web 43 is severed generally along a horizontal line of severence, each fan-fold portion (unnumbered) in any one of the secondary webs 50, 51 is also normal to the major plane of such secondary webs. Obviously, the mineral fibers are also aligned normal to the major plane of these webs 50, 51 and the eventually formed laminate exiting the curing oven 5, thus creating a marked increased in compression strength normal or perpendicular to the major surfaces of the panels.

While the fan-folds 45 have been shown generally normal to the direction of movement of the conveyor 44, the rate of movement and the rate of oscillation by the means 42 to form the fan-folds 45 can be such that the fan-folds 45 are stacked horizontally relative to each other in groups along the length of the eventually formed web 43 or are inclined in a shingle-like fashion at a very acute angle to the horizontal. The particular disposition and inclination of the fan-folds 43 depends to a major extent to the final product characteristic desired.

It is also to be understood in accordance with this invention that the speed of conveyence of the various mineral fiber webs 7, 8, 19, 20 can be varied so that, for example, the mineral fiber webs are compressed in the direction of advance and/or transversely thereto. Illustratively, this can be carried out by driving the conveyor belts for the secondary mineral fiber webs at different speeds whereby at least one of the secondary mineral fiber webs will be compressed in the direction of advance relative to the other of the secondary mineral fiber webs.

Additionally, though not illustrated, equipment is also provided in keeping with this invention to prevent any of the mineral fiber webs which are being compressed from spreading laterally as, for example, edge confinement plates or guide plates. However, in further accordance with this invention, the latter guide plates may instead be substituted for by further compression means, such as the rollers 9, 10 to impart transverse compression to the direction of advance of the secondary mineral fiber webs.

Although a preferred embodiment of the invention has been specifically illustrated and described herein, it is to be understood that minor variations may be made in the apparatus and the method without departing from the spirit and scope of the invention, as defined in the appended claims.

I claim:

1. The method of manufacturing a laminated cured multi-ply mineral fiber folded web comprising the steps of providing an uncured primary nonwoven mineral fiber web treated with a binding agent, conveying the primary nonwoven mineral fiber web along a predetermined path of travel, compacting the primary nonwoven mineral fiber web, compressing the uncured primary nonwoven mineral fiber web substantially beyond the initial compaction thereof, applying air-permeable and thermally stable reinforcing material to the compressed mineral fiber web, fan-folding the compressed mineral fiber web by forming contiguous folds of a predetermined height with the folds being disposed generally transverse to the direction of travel as the folds form a fan-folded mineral fiber web, severing the fan-folded nonwoven mineral fiber web so as to form therefrom at least two secondary mineral fiber webs, performing the severing along a plane generally transverse to the direction of the fan-folds, subjecting at least one of the at least two severed secondary mineral fiber webs to at least one subsequent treatment step, thereafter positioning the at least one severed secondary mineral fiber web and the remaining severed secondary mineral fiber web into contiguous relationship to each other, and curing the binding agent to adhere the severed secondary mineral fiber webs to each other thereby forming a laminated cured multi-ply mineral fiber web.

2. The method as defined in claim 1 including the step of partially curing the fan-folded nonwoven mineral fiber web prior to the severing thereof.

3. The method as defined in claim 1 including the step of further compressing at least one of the at least one and remaining severed secondary mineral fiber webs in a direction normal to the direction of travel of the further compressed severed secondary mineral fiber web.

4. The method as defined in claim 1 including the step of further compressing at least one of the at least one and remaining severed secondary mineral fiber webs in a direction transverse to the direction of travel of the further compressed severed secondary mineral fiber web.

5. Apparatus for manufacturing a cured mineral fiber fan-folded web comprising means for forming an uncured primary nonwoven mineral fiber web treated with a binding agent, means for conveying the primary nonwoven mineral fiber web along a predetermined path of travel, means for compacting the primary nonwoven mineral fiber web, means for compressing the uncured primary nonwoven mineral fiber web substantially beyond the initial compaction thereof, means for applying air-permeable and thermally stable reinforcing material to the compressed mineral fiber web, means for fan-folding the compressed mineral fiber web by forming contiguous fan-folds of a predetermined height thereby forming a fan-folded mineral fiber web, conveying the nonwoven mineral fiber web as it is being fan-folded formed along a predetermined path of travel generally transverse to the disposition of the fan-folds, means for severing the fan-folded non-woven mineral fiber web so as to form therefrom at least two secondary mineral fiber webs by severing along a plane generally transverse to the direction of the fan-folds means for subjecting at least one of the at least two severed secondary mineral fiber webs to at least one subsequent treatment step, means for thereafter positioning the at least one severed secondary mineral fiber web and the remaining severed secondary mineral fiber web into contiguous relationship to each other, and means for curing the binding agent to adhere the severed secondary mineral fiber webs to each other thereby forming a laminated cured multi-ply mineral fiber web.

6. The apparatus as defined in claim 5 including means for applying web material to the uncrued primary nonwoven mineral fiber web after the same has been at least partially compressed by said compression means.

7. The apparatus as defined in claim 5 wherein said fan-folding means continuously swing the compressed mineral fiber web along an oscillating path of travel thereby imparting the fan-folds thereto.

8. The apparatus as defined in claim 5 wherein said fan-folding means continuously swing the compressed mineral fiber web along an oscillating path of travel thereby imparting the fan-folds thereto, and said fan-folding means include a pair of opposed conveying means mounted for swinging movement.

9. The apparatus as defined in claim 5 wherein said compressing means are a pair of compression rollers.

10. The apparatus as defined in claim 5 wherein said compressing means are a pair of compression belts.

11. The apparatus as defined in claim 5 wherein said compressing means are two pair of compression rollers spaced from each other.

12. The apparatus as defined in claim 5 including means for conveying each of the two severed secondary mineral fiber webs each along a predetermined individual path of travel, said last-mentioned conveying means include at least one pair of endless conveyors between which each of the two secondary mineral fiber webs are conveyed, and means for driving each pair of endless conveyors at different speeds to thereby compress the mineral fibers of the slower driven of the two pair of endless conveyors relative to the mineral fibers of the faster driven of the two pair of endless conveyors.

13. The apparatus as defined in claim 5 including means for laterally compressing one of the two severed secondary mineral fiber webs.

14. The apparatus as defined in claim 1 including means for partially curing the fan-folded nonwoven mineral fiber web prior to the severing thereof.

* * * * *